US007341763B2

(12) United States Patent
Miyamoto et al.

(10) Patent No.: US 7,341,763 B2
(45) Date of Patent: Mar. 11, 2008

(54) THERMAL SPRAYING DEVICE AND THERMAL SPRAYING METHOD

(75) Inventors: Noritaka Miyamoto, Toyota (JP); Hajime Kubota, Toyota (JP); Nobuhide Kondo, Kariya (JP); Kouta Kodama, Toyota (JP); Toshinao Suzuki, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 11/111,894

(22) Filed: Apr. 22, 2005

(65) Prior Publication Data

US 2005/0186355 A1 Aug. 25, 2005

(51) Int. Cl.

| | |
|---|---|
| ***C23C 4/12*** | (2006.01) |
| ***B05D 1/08*** | (2006.01) |
| ***B05B 1/24*** | (2006.01) |

(52) U.S. Cl. ..... 427/449; 239/81; 239/83; 219/76.14

(58) Field of Classification Search ..... 427/449
See application file for complete search history.

(56) References Cited

U.S. PATENT DOCUMENTS

| | | | | |
|---|---|---|---|---|
| 3,901,441 | A * | 8/1975 | Kasagi | 239/81 |
| 5,245,153 | A * | 9/1993 | Singer et al. | 219/76.15 |
| 5,584,433 | A * | 12/1996 | Nakagawa | 239/8 |
| 5,714,205 | A | 2/1998 | Marantz et al. | |
| 5,908,670 | A * | 6/1999 | Dunkerley et al. | 427/449 |
| 6,091,042 | A | 7/2000 | Benary | |
| 2004/0094088 | A1 | 5/2004 | Miyamoto et al. | |
| 2004/0231596 | A1* | 11/2004 | George | 118/722 |

FOREIGN PATENT DOCUMENTS

| | | |
|---|---|---|
| DE | 102 04 251 A1 | 2/2002 |
| WO | WO 91/12183 | 8/1991 |
| WO | WO 03/090936 A1 | 11/2003 |

OTHER PUBLICATIONS

European Search Report dated Sep. 15, 2005.

* cited by examiner

*Primary Examiner*—Katherine Bareford
(74) *Attorney, Agent, or Firm*—Finnegan, Henderson, Farabow, Garrett & Dunner L.L.P.

(57) ABSTRACT

A thermal spraying device with a first blowing mechanism for lengthening a droplet formed near the tips of thermal spraying materials by arc, and a second blowing mechanism for a blowing a tip portion of the lengthened droplet to atomize it into droplets and to scatter atomized droplets towards a face to be thermally sprayed. The first blowing mechanism lengthens the droplet so that the second blowing mechanism propels air to the tip portion of the lengthened droplet that is separated from a location where the tips of thermal spraying materials are adjacent and the arc is generated. Arcing between the tips of the thermal spraying materials continues stably, and satisfactory thermal spraying is possible.

7 Claims, 16 Drawing Sheets

FIG. 21

| W (L/Min) | 0 | 28 | 70 | 140 | 280 | 420 | 560 | 700 | 840 | 980 | 1120 |
|---|---|---|---|---|---|---|---|---|---|---|---|
| Ratio (%) | 0 | 2 | 5 | 10 | 20 | 30 | 40 | 50 | 60 | 70 | 80 |
| Type1 | × | △ | ○ | ○ | ○ | △ | △ | × | × | × | × |
| Type2 | × | △ | ○ | ○ | ○ | ○ | ○ | △ | × | × | × |
| Type3 | × | △ | ○ | ○ | ○ | ○ | ○ | ○ | △ | △ | × |

THERMAL SPRAYING DEVICE AND THERMAL SPRAYING METHOD

BACKGROUND OF THE INVENTION

1. Field of the Invention

The present invention relates to a device and a method for forming a thermally sprayed coating on a face of a base material.

2. Description of the Related Art

A technique that an inner circumference face of a bore of an aluminum cylinder block is strengthened by thermally spraying a metal such as iron or the like onto the inner circumference face is known. There are vigorous research activities in the field of thermal spraying techniques. Especially intense research activities are being carried out on arc thermal spraying techniques, which allow cheap operating cost, to replace plasma thermal spraying techniques, in which operating cost is expensive. In the arc thermal spraying techniques, two wire-shaped thermal spraying materials, in which differing voltages are applied between the two wire-shaped thermal spraying materials, are delivered to a location where the tips of both are adjacent. Thereupon, an arc is generated between the tips, thus forming droplet of the thermal spraying material by the arc. An air current, for atomizing the droplet and scattering atomized droplets of the thermal spraying materials is directed towards a face to be thermally sprayed through the droplet. The air current atomizes the droplet into fine droplets and the atomized droplets are smashed and piled on the face to be thermally sprayed. The wire-shaped thermal spraying materials are delivered such that they can be maintained in a positional relationship in which their tips, which are being consumed, remain mutually adjacent. U.S. Pat. No. 6,091,042 issued to Benary teaches a technique in which an air current is propelled towards droplet formed in a region adjacent the tips of two thermal spraying materials and the atomized droplets are consequently smashed onto the face to form the thermal spraying coating.

In a case where an inner circumference of a bore or the like is to be thermally sprayed, thermal spraying must be performed such that an area of atomized droplets scattered onto the bore inner face moves along a circumferential direction of the inner circumference face of the bore. In the prior art, the thermal spraying device is fixed in position and the cylinder block is rotated so that the inner circumference face of the bore moves in a circumferential direction around the thermal spraying device.

The method of rotating the cylinder block has a problem that only one cylinder bore can be thermally sprayed at a time, and the thermal spraying process is consequently time consuming.

A technique to deal with this problem is set forth in U.S. Pat. No. 5,714,205 issued to Marantz et al. In this technique, the location in which the tips of the wire-shaped thermal spraying materials are adjacent is treated as a center, and a plurality of air current propelling nozzles is disposed around the center. Each of air current propelling nozzles propels an air current toward the center. By using the plurality of air current propelling nozzles disposed around the center, the direction of the air current can be made to rotate, for example, in a clockwise direction by activating one of the air current propelling nozzles sequentially in the clockwise direction. There is no need to rotate the cylinder block or the like with this technique. Further, there is also no need to rotate the thermal spraying device.

BRIEF SUMMARY OF THE INVENTION

In the technique set forth in U.S. Pat. No. 6,091,042 issued to Benary, as described above, air current is propelled towards the droplet formed by the arc at the region adjacent the tips of the thermal spraying materials. The air current must be strongly propelled so as to atomize the droplet and smash the atomized droplets onto the face to be coated. However, it is difficult to maintain the arcing between the tips of the thermal spraying materials when the air current is strongly propelled towards the tips of the thermal spraying materials, and the arcing between the tips becomes unstable. As a result, atomized droplets are not homogeneous and the droplets or particles piled on the face to be coated are not homogeneous. Satisfactory thermally sprayed coating cannot be obtained.

The present invention aims to solve this problem, and presents a technique in which high quality thermally sprayed coating can be obtained.

A thermal spraying device of the present invention comprises a delivery mechanism for delivering a plurality of wire-shaped thermal spraying materials to maintain a positional relationship where tips of the thermal spraying materials are located mutually adjacent while the tips of the thermal spraying materials are consumed and an exciting mechanism for applying voltage difference between the plurality of thermal spraying materials to generate an arc between the tips of the thermal spraying materials.

The thermal spraying device of the present invention further comprises a first blowing mechanism for lengthening droplet formed near the tips of the thermal spraying materials by the arc and a second blowing mechanism for blowing tip portion of lengthened droplet to atomize the droplet and to smash atomized droplets onto a face to be thermally sprayed.

In the present invention, there is provided the first blowing mechanism that lengthens droplet formed near the tips of the thermal spraying materials by the arc. The first blowing mechanism does not need high speed blowing, therefore, the arc between the tips of the thermal spraying materials can be maintained stable.

The second blowing mechanism needs high speed blowing in order to atomize the droplet and to smash atomized droplets onto the face to be coated. If the high speed blowing is propelled directly towards the tips of the thermal spraying materials, stable arcing cannot be obtained. However, in the present invention, the high speed blowing by the second blowing mechanism is not directed towards the tips of the thermal spraying materials, instead, the high speed blowing by the second blowing mechanism is directed towards the tip portion of the lengthened droplet. The tip portion of the lengthened droplet is separated from the tips of the thermal spraying materials. The high speed blowing by the second blowing mechanism does not make the arcing between the tips of the thermal spraying materials unstable. As a result, satisfactory thermally sprayed coating can be obtained.

The term 'adjacent' refers not only to a state in which the tips of the thermal spraying materials are not in contact, but also refers to a state in which they are in contact. Arcing may be generated even the tips of the thermal spraying materials are in contact.

In the aforementioned thermal spraying device, it may be preferred that the second blowing mechanism is disposed in a symmetrical plane of two wire-shaped thermal spraying materials.

Performing thermal spraying with this positional relationship promotes the formation of the atomized droplets into very fine particles, and allows a fine textured thermally sprayed coating to be formed.

According to the technique set forth in U.S. Pat. No. 5,714,205 issued to Marantz et al, by activating one of air current propelling nozzles arranged circumferentially around the tips of the thermal spraying materials, the direction of the air current for atomizing the droplet and scattering the atomized droplets rotates. However, when this method was investigated by the present inventor, it was found that a high quality thermally sprayed coating is not formed, and that the thermally sprayed coating easily peels off. It was supposed that this was caused by the sudden change in the direction of the air current that occurred when the propelling nozzles were switched sequentially.

To deal with this, the present inventors tested an improvement in which a single propelling nozzle is rotated around the tips of the thermal spraying materials continuously. However, as will be described later in the reference example, this did not yield a great improvement. Unless this problem can be solved, the inefficient method must be adopted in which the cylinder block is rotated and only one cylinder bore can be thermally sprayed at a time.

The present inventors performed extensive research to discover why high quality thermal spraying was not possible when the direction of air current continually rotates with respect to the tips of the wire-shaped thermal spraying materials. As a result, the present inventors discovered that there was an important relationship between the position of the tips of wire-shaped thermal spraying materials and the direction of the air current. The present inventors discovered that this positional relationship greatly affects the atomization of the droplet into fine particles.

For example, in the case where two wire-shaped thermal spraying materials are utilized, the two wire-shaped thermal spraying materials are disposed so as to form a V-shape so that tips of both thermal spraying materials are adjacent. The inventors discovered that there was a large difference in the characteristics of the thermally sprayed coating when the air current was propelled from a front face of the V-shape and when the air current was propelled from a side face of the V-shape. From this, the present inventors confirmed that this was the reason why satisfactory thermal spraying was not possible when the direction of the air current was rotated continually with respect to the tips of the wire-shaped thermal spraying materials.

In order to overcome that problem, it is preferred that the thermal spraying device is provided with a rotating mechanism for rotating the entirety of the delivery mechanism, the exciting mechanism, the first blowing mechanism for lengthening the droplet, and the second blowing mechanism for atomizing the droplet and scattering atomized droplets towards the face to be coated.

The rotating mechanism of the thermal spraying device rotates the entirety of the delivery mechanism, the first blowing mechanism, and the second blowing mechanism. As a result, thermal spraying can be continued without any change in the positional relationship between the thermal spraying materials and the direction of blowing current, and consequently a high quality thermally sprayed coating can be formed homogeneously along the entire inner surface of the bore.

It may be preferred that the tips of the thermal spraying materials are located in a position offset from a rotary center of the rotating mechanism so that a distance from the tips of the thermal spraying materials to the face to be thermally sprayed is optimized.

According to this device, the thermal spraying operation can be performed while the distance from the tips of the thermal spraying materials to the face to be thermally sprayed is optimized.

It may be preferred that the second blowing mechanism for atomizing the droplet and scattering atomized droplets towards the face to be coated is provided with a mechanism for blowing low speed air current and a mechanism for blowing high speed air current, the former being disposed close to the tips of the thermal spraying materials and the latter being disposed far from the tips of the thermal spraying materials. In this case, it my be preferred that the thermal spraying device is further provided with a moving mechanism that moves the entirety of the delivery mechanism, the exciting mechanism, the first blowing mechanism, and the second blowing mechanism from the side with the high speed blowing mechanism to the side with the low speed blowing mechanism.

The droplets atomized by low speed air current are larger in size than the droplets atomized by high speed air current. When the moving mechanism moves the entirety of the thermal spraying device from the side with the high speed blowing mechanism to the side with the low speed blowing mechanism, larger droplets atomized by low speed air current reach the face to be coated at first, and subsequently smaller droplets atomized by high speed air current reach the thermally sprayed coating formed from the larger atomized droplets.

The thermally sprayed coating formed from the larger atomized droplets adheres strongly to the face of a base material. The thermally sprayed coating formed from smaller atomized droplets adheres strongly to the thermally sprayed coating formed from larger atomized droplets. The smaller atomized droplets form a finely textured thermally sprayed coating. As a result, it is possible to form a high quality thermally sprayed coating that has strong adherence and does not easily peel off, and in which a surface of the coating is finely textured.

A thermal spraying method of the present invention comprises a step of delivering a plurality of wire-shaped thermal spraying materials to maintain a positional relationship where tips of the thermal spraying materials are located mutually adjacent while the tips of the thermal spraying materials are consumed, a step of applying voltage difference between the plurality of thermal spraying materials to generate an arc between the tips of the thermal spraying materials, a first step of blowing droplet formed near the tips of the thermal spraying materials by the arc to lengthen the droplet, and a second step of further blowing tip portion of lengthened droplet to atomize the droplet and to scatter atomized droplets towards a face to be thermally sprayed.

When thermal spraying is performed in this manner, the strong air current for atomizing the droplet and scattering atomized droplets does not make direct contact with the tips of the thermal spraying materials and the arcing between the tips can therefore continue stably. As a result, satisfactory thermal spraying is possible.

It may be preferred that the step of blowing tip portion of lengthened droplet comprises a step of blowing the droplet with low speed and a step of blowing the droplet with high speed. In this case, it may be preferred that the face is coated with droplets or particles atomized with low speed at first and subsequently coated with droplets or particles atomized with high speed.

When thermal spraying is performed in this manner, a thermally sprayed coating formed from larger atomized droplets is formed on a face of a base material. The thermally sprayed coating formed from the larger atomized droplets adheres strongly to the face of the base material. Subsequently, a thermally sprayed coating formed from smaller atomized droplets is formed on the thermally sprayed coating formed from the larger atomized droplets. The thermally sprayed coating formed from the smaller atomized droplets adheres strongly to the thermally sprayed coating formed from the larger atomized droplets. The smaller atomized droplets form a finely textured thermally sprayed coating. As a result, it is possible to form a high quality thermally sprayed coating that has strong adherence and does not easily peel off, and in which a surface of the coating is finely textured.

BRIEF DESCRIPTION OF THE DRAWINGS

FIG. 21 is a table summarizing the short-circuiting condition between the tips of wires when thermal spraying was performed using the thermal spraying devices of the first embodiment, the second embodiment, and the third embodiment.

DETAILED DESCRIPTION OF THE INVENTION

Several preferred features to practice the present invention are listed below.

(Feature 1)

A first blowing mechanism for lengthening the droplet is disposed along a symmetrical plane of two wire-shaped thermal spraying materials, and blows air current in a delivery direction of the wire-shaped thermal spraying materials. The 'delivery direction of the thermal spraying materials' refers to an average delivery direction of the two thermal spraying materials.

With this type of configuration, it is possible to lengthen the droplet in the delivery direction of the thermal spraying materials.

(Feature 2)

A first blowing mechanism for lengthening the droplet blows air along each of the thermal spraying materials.

(Feature 3)

A first blowing mechanism for lengthening the droplet blows two or more air currents that merge, and the negative pressure created by these air currents lengthens the droplet

REFERENCE EXAMPLE

In the process of completing the present invention, the present inventors repeated various tests by using various versions of the thermal spraying device. The results of these tests are described below.

Figure 14:
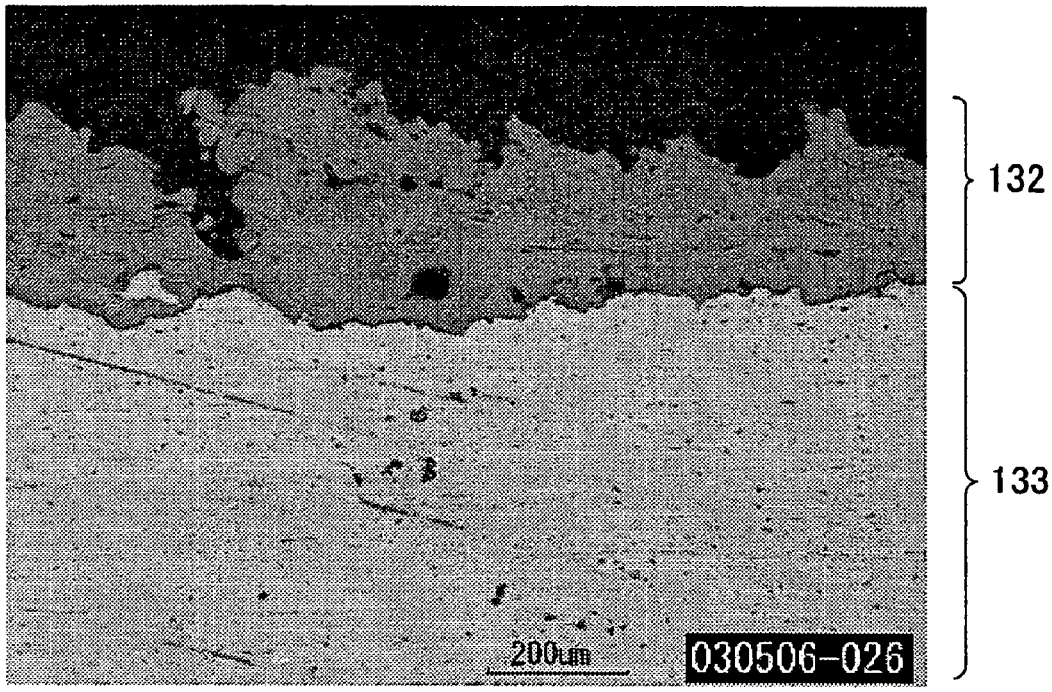
FIG. 14 shows a photograph of a cut plane of a thermally sprayed coating of a reference example.
Figure 15:
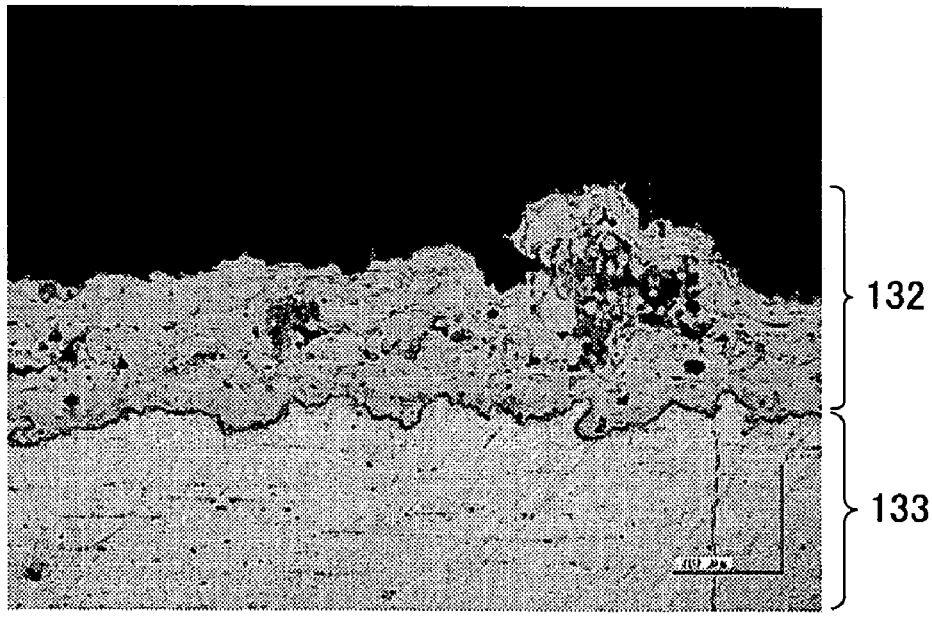
FIG. 15 shows a photograph of a cut plane of a thermally sprayed coating of the reference example.

FIGS. 14 and 15 show photographs of a cut plane of a thermally sprayed coating 132 and a base material 133 (a cylinder block) equivalent to those formed by using the thermal spraying device taught by U.S. Pat. No. 5,714,205 issued to Marantz et al, which has been described above. The thermally sprayed coating 132 shown in FIG. 14 was formed on an inner circumferential face of a bore by means of propelling atomizing air along a direction orthogonal to a V-shape formed by two wire-shaped thermal spraying materials. The thermally sprayed coating 132 shown in FIG. 15 was formed on the inner circumferential face of the bore by means of propelling atomizing air along a sideways direction relative to the V-shape formed by two wire-shaped thermal spraying materials (a direction parallel with the V-shape). As is clear from FIGS. 14 and 15, a surface of the thermally sprayed coating 132 is extremely uneven, and is undesirable. The causes of this extreme unevenness were conjectured to be as follows.

One reason may be that the direction of the atomizing air changes suddenly when the air current propelling nozzles disposed around the center is selected. The other reason may be that the direction of the atomizing air is inclined with respect to the face of the base material. The air current propelling nozzles direct the atomizing air current obliquely downwards. Consequently, the atomized droplets cannot be sprayed at a right angle onto the base material. If the atomized droplets are not sprayed at a right angle onto the base material, the atomized droplets tend to pile up uneven surface of the sprayed coating (a screening effect), and the unevenness becomes even greater.

Further, the thermal spraying device set forth in U.S. Pat. No. 5,714,205 issued to Marantz et al. has a configuration in which a plurality of air current propelling nozzles is disposed around the tips of the thermal spraying materials, and in which each of the air current propelling nozzles propels the air current towards the tips of the thermal spraying materials. The atomizing air current directed towards the tips of the thermal spraying materials makes the arcing between the tips of the thermal spraying materials unstable. The unstable arcing generates unevenness at the surface of the coating.

Further, each of the air current propelling nozzles propels the air current obliquely downwards. This means that there must be a large distance between the tips of the wire materials and each of the air current propelling nozzles, since, if the distance between the tips of the wire materials and the air current propelling nozzle was reduced, there would be insufficient space for thermally spraying the atomized droplets onto the face of the base material. A large distance between the tips of the wire materials and the air current propelling nozzle means that the air current must be strongly propelled so as to adequately atomize the droplet. However, the droplet is cooled excessively if the atomizing air current is propelled too strongly, and a high quality sprayed coating cannot be formed. For this reason, U.S. Pat. No. 5,714,205 issued to Marantz et al. proposes heating the atomizing air current. As will be described in detail below, the thermal spraying device of the present invention allows the formation of a high quality sprayed coating without heating the atomizing air current.

Figure 16:
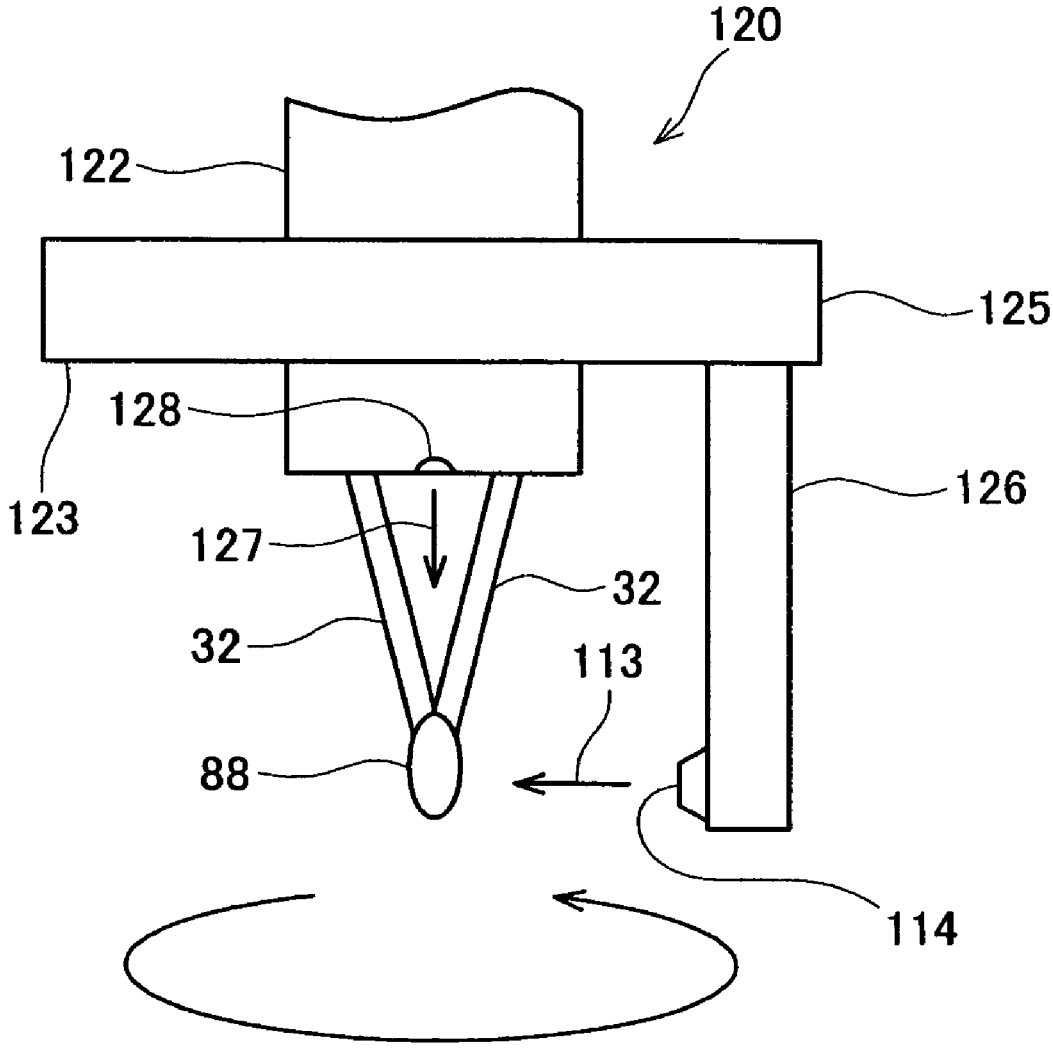
FIG. 16 shows a schematic view of a thermal spraying device of the reference example.

FIG. 16 shows a schematic view of a front part 120 of a tool main body of a reference example device made by the present inventors. The front part 120 is provided with a fixed member 122 and a rotating member 123 that rotates around the fixed member 122. The fixed member 122 supports two wires 32 in a state whereby tips thereof make contact. An auxiliary nozzle 128, this blowing auxiliary air 127 towards the contacting tips of the wires 32, is formed in the fixed member 122. The rotating member 123 has a rotating main body 125 and a nozzle member 126 that protrudes downwards from an outer peripheral part of the rotating main body 125. An atomizing nozzle 114 opens at a lower end portion of the nozzle member 126. The atomizing nozzle 114 propels atomizing air 113 towards the center of the rotation of the rotating member 123.

With this thermal spraying device, low speed air is blown from the auxiliary nozzle 128 while different voltages are applied between the wires 32, and high speed atomizing air 113 is propelled from the atomizing nozzle 114 towards the center while the atomizing nozzle 114 is being rotated by the rotating member 123. Arc is generated between the tips of the wires 32, and droplet 88 is generated at a region adjacent to the tips of the wires 32. The droplet 88 contains melted thermal spraying material and is lengthened downwards by the auxiliary air 127. The atomizing air 113 is directed towards tip portion of the lengthened droplet 88, then the droplet 88 is atomized into fine droplets or particles and atomized droplets are blown onto the inner face of the bore. Finely atomized droplets are thermally sprayed onto the inner face of the bore.

By the reference example device as shown in FIG. 16, the inventor confirmed the merit of the combination of the auxiliary nozzle 128 and the atomizing nozzle 114. The auxiliary nozzle 128 lengthens droplet 88 downwardly. The atomizing nozzle 114 blows strong air current towards tip portion of lengthened droplet 88, and strong air current is not directed towards the tips of wires 32. The arcing between the tips of wires 32 is isolated from the strong air current for atomizing, and the acing continues stably.

Figure 17:
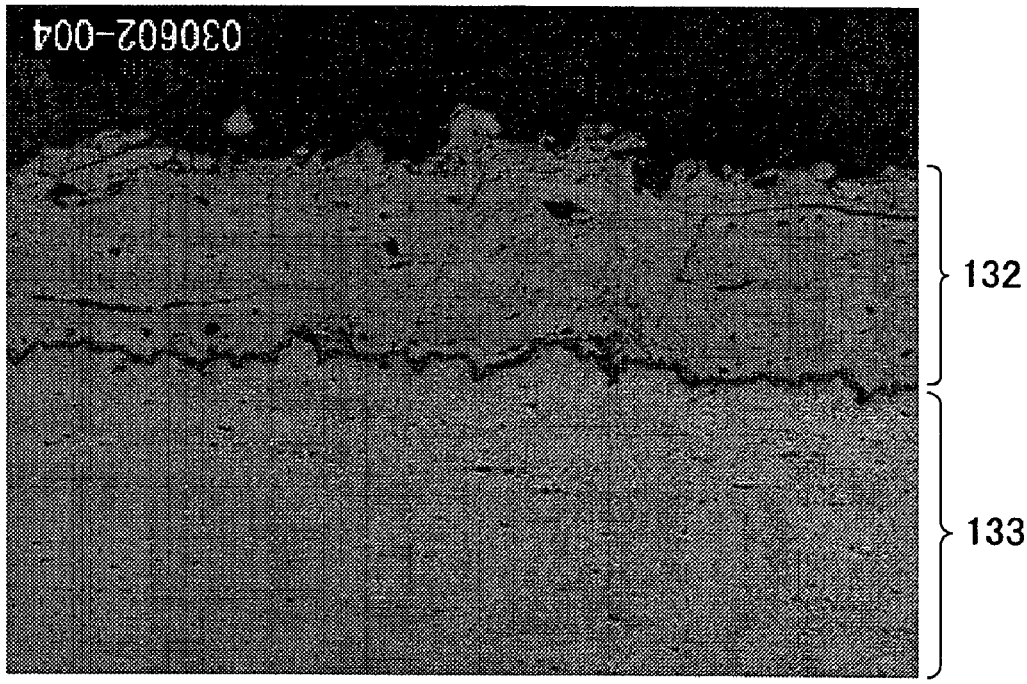
FIG. 17 shows a photograph of a cut plane of a thermally sprayed coating of the reference example.
Figure 18:
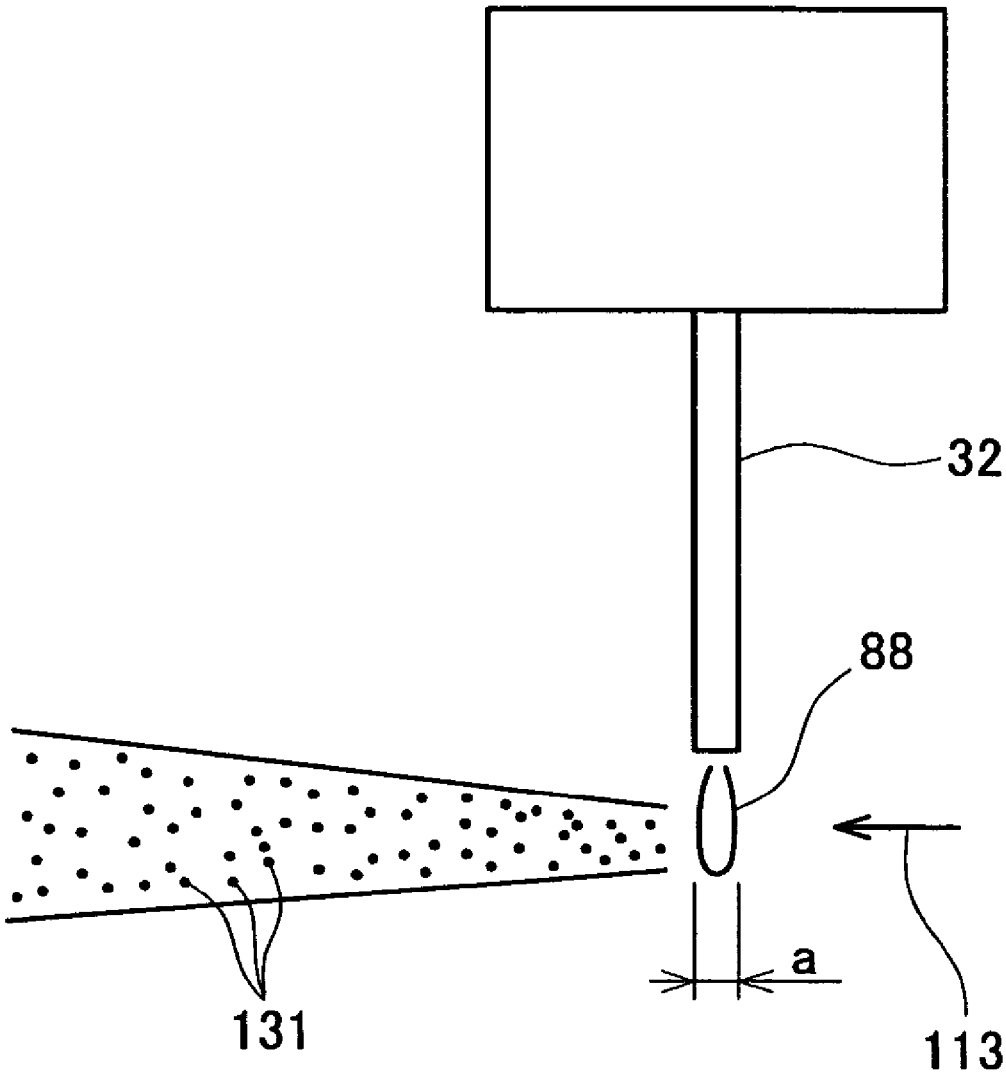
FIG. 18 schematically shows a state in which the thermal spraying device of the reference example is performing thermal spraying.

FIG. 17 shows the thermally sprayed coating 132 formed on the inner face of the bore when the droplet 88 was atomized into fine droplets 131 as shown in FIG. 18. In this case, as shown in FIG. 18, the atomizing nozzle 114 was located so as to propel the atomizing air 113 to the droplet 88 along a direction orthogonal to the V-shape formed by the wires 32. As is clear from FIG. 17, a high quality thermally sprayed coating is formed in which the size of the sprayed droplets is uniform.

Figure 19:
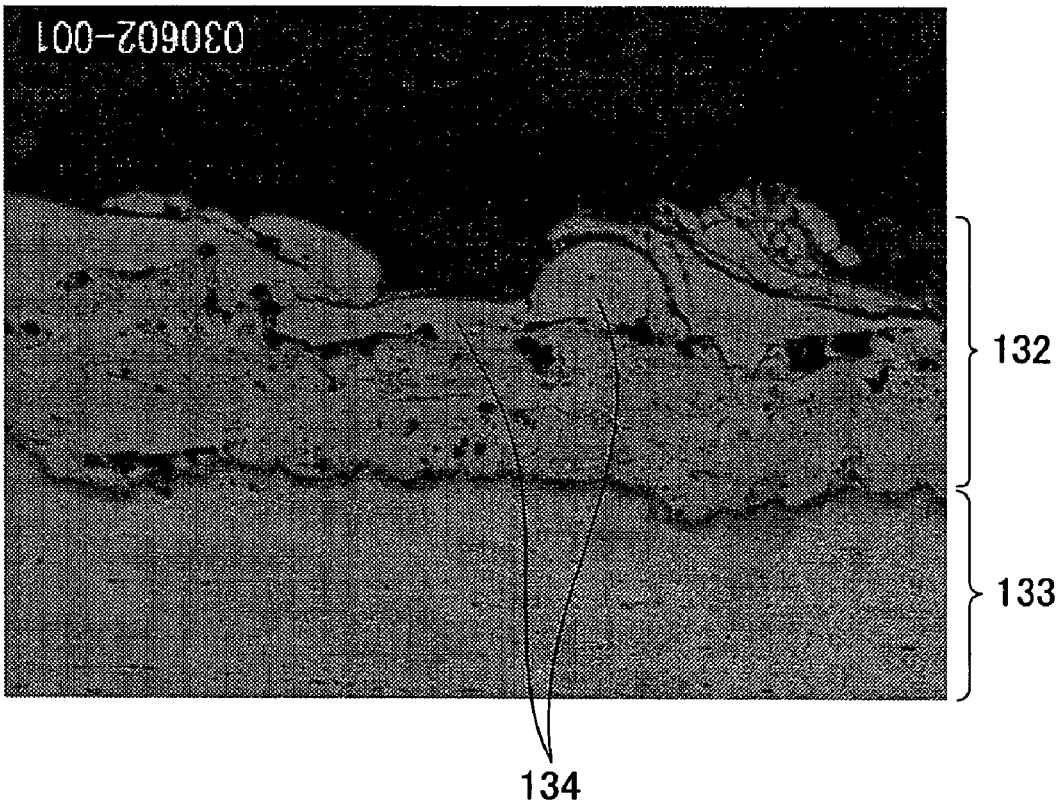
FIG. 19 shows a photograph of a cut plane of a thermally sprayed coating of the reference example.
Figure 20:
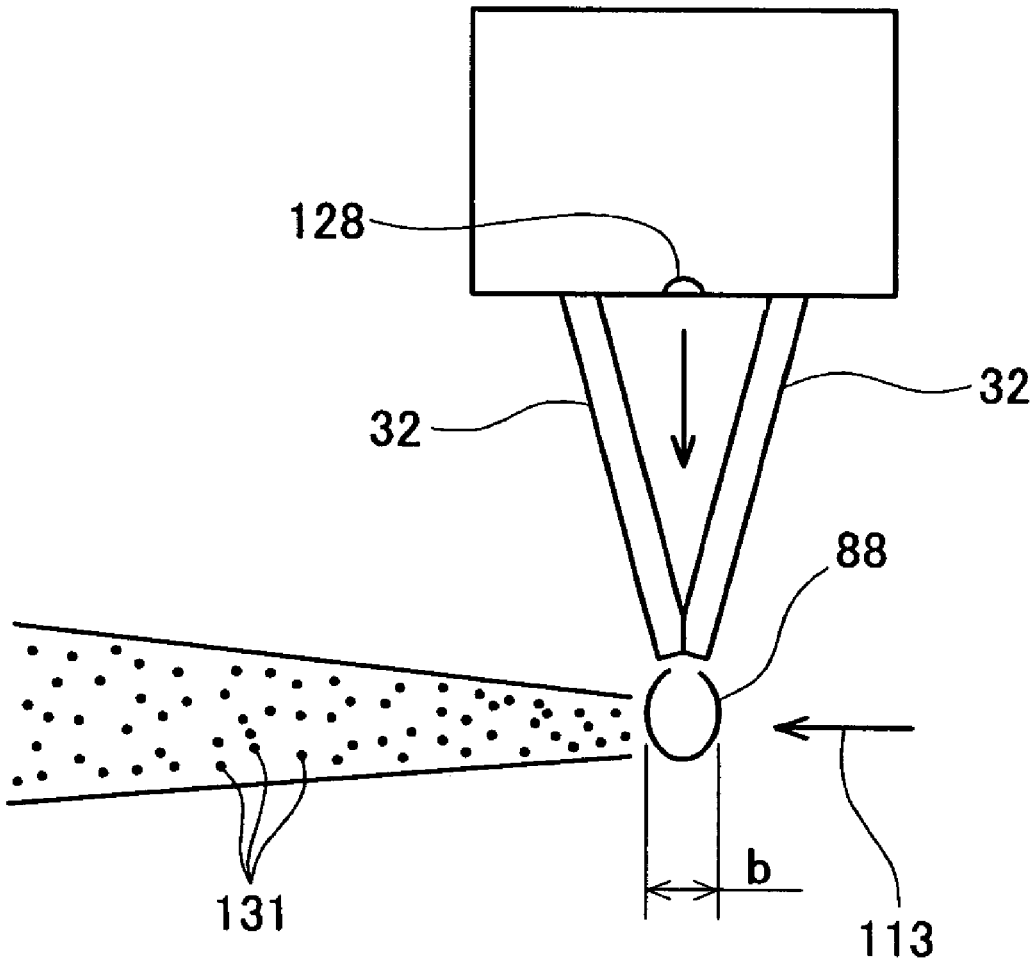
FIG. 20 schematically shows a state in which a thermal spraying device of the reference example is performing thermal spraying.

FIG. 19 shows the thermally sprayed coating 132 formed in a condition as shown in FIG. 20. In the case, as shown in FIG. 20, the atomizing nozzle 114 was located so as to propel the atomizing air 113 to the droplet 88 along a direction parallel with the V-shape formed by the wires 32. In this case, numerous large atomized droplets 134 that were not adequately atomized are included in the thermally sprayed coating 132.

While the atomizing nozzle 114 is rotated by the rotating member 123, both conditions as shown in FIG. 18 and FIG. 20 occur in turn, therefore, high quality thermally sprayed coating could be formed on parts of the inner face of the bore, however, a high quality thermally sprayed coating could not be formed along the entire circumference of the inner face of the bore.

A conjecture is given below concerning the reason why a high quality thermally sprayed coating could not be formed along the entire circumference of the inner face of the bore.

Viewed from the direction parallel with the V-shape as shown in FIG. 18, the width "a" of the droplet 88 is narrow. Viewed from the direction orthogonal to the V-shape as shown in FIG. 20, the width "b" of the droplet 88 is wide. The reason for this is that the width of the droplet 88 depends on the width of the tips of the wires 32. That is, the width of the tips of the wires 32 viewed from the direction orthogonal to the V-shape formed by the wires 32 is wide, and consequently the width "b" of the droplet 88 is wide. As shown in FIG. 18, the width of the tips of the wires 32 viewed from the direction parallel with the V-shape formed by the wires 32 is narrow, and consequently the width "a" of the droplet 88 is also narrow. In the state shown in FIG. 18, the atomizing air 113 is propelled to the droplet 88 which has the narrow width "a" (which is thin), and consequently the droplet 88 is finely atomized and forms atomized droplets 131 that are uniform in size. In the state shown in FIG. 20, the atomizing air 113 is propelled to the droplet 88 which has the wide width "b" (which is fat), and consequently the droplet 88 is insufficiently atomized. As a result, large atomized droplets 134 shown in FIG. 19 are thermally sprayed. This means that a high quality thermally sprayed coating 132 cannot be formed along the entire circumference of the inner face of the bore if there is a change in the direction from which the atomizing air is propelled to the wires 32. The large atomized droplets 134 (see FIG. 19) included in the thermally sprayed coating 132 easily fall out when the inner face of the bore is honed, thus causing large concave defects in the surface of the thermally sprayed coating 132.

PREFERRED EMBODIMENTS

Preferred embodiments of the present invention were completed by further studying the reference example described above.

First Embodiment

A thermal spraying device of a first embodiment of the present invention will now be described with reference to figures.

Figure 1:
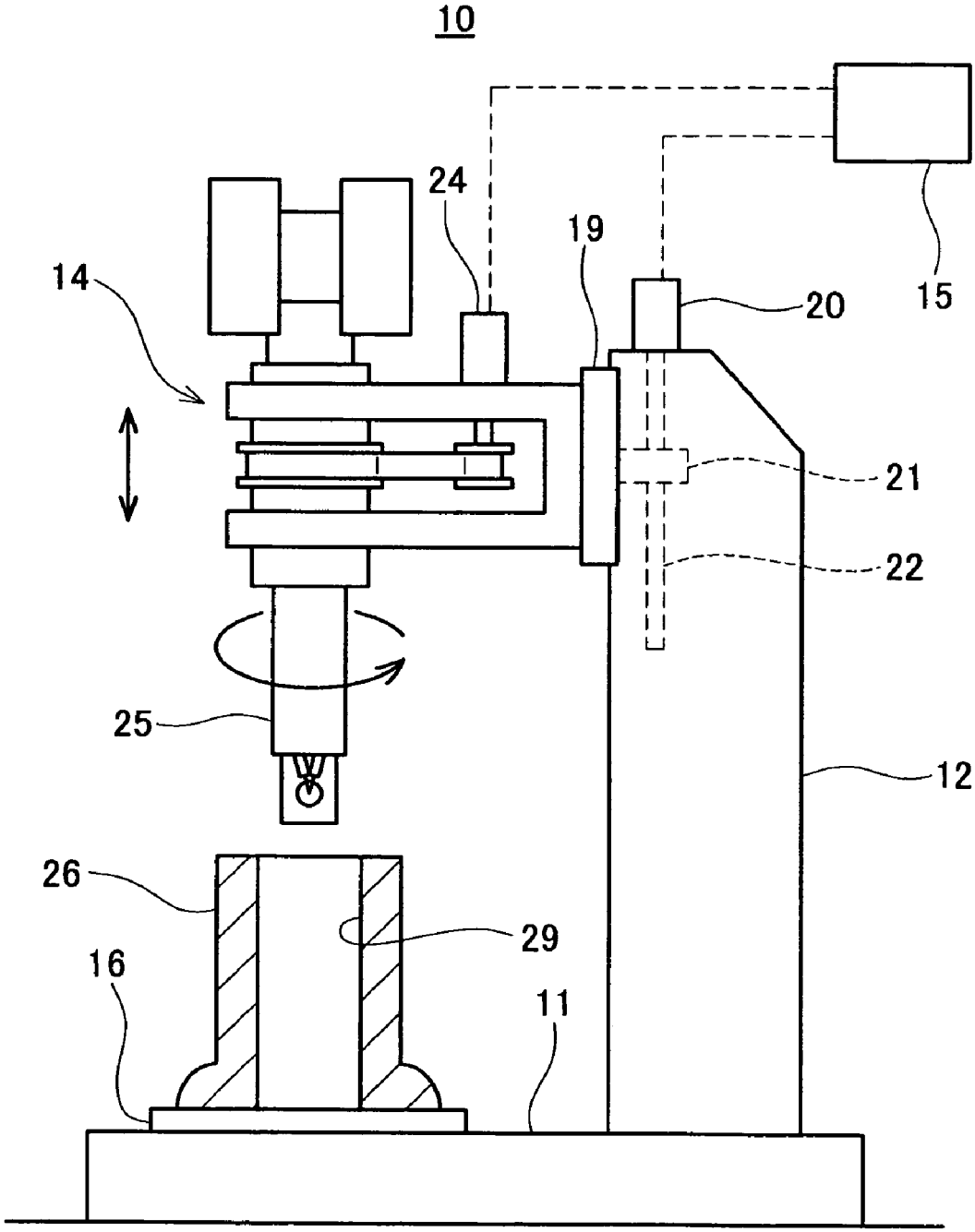
FIG. 1 shows a schematic view of a thermal spraying device of a first embodiment.

FIG. 1 schematically shows the thermal spraying device 10. The thermal spraying device 10 is provided with a base 11, a supporting member 12, a thermal spraying tool part 14, a controller 15 and a plate 16. The supporting member 12 is located on the base 11, and supports a slider 19 that can slide upwards and downwards. The controller 15 is connected with a motor 20 for raising and lowering the slider 19. The motor 20 is attached to an upper part of the supporting member 12. A spiral screw 22 is attached to a rotary shaft of the motor 20. A support 21 fixed to the slider 19 is screwed onto the screw 22. The controller 15 controls the direction and speed of rotation of the motor 20 for raising and lowering the slider 19. With this structure, the thermal spraying tool part 14 is raised or lowered when the motor 20 rotates. The controller 15 is also connected with a motor 24 for rotation (to be described).

A tool main body 25 of the thermal spraying tool part 14 rotates around its axis when the motor 24 for rotation is driven (the configuration for rotating the tool main body 25 will be described in detail later). The plate 16 is attached to the top of the base 11, and a cylinder block 26 is mounted thereon. The tool main body 25 rotates while moving upwards or downwards within a bore 29 of the cylinder block 26, and this tool main body 25 thermally sprays atomized droplets or particles onto an inner face of the bore 29.

Figure 2:
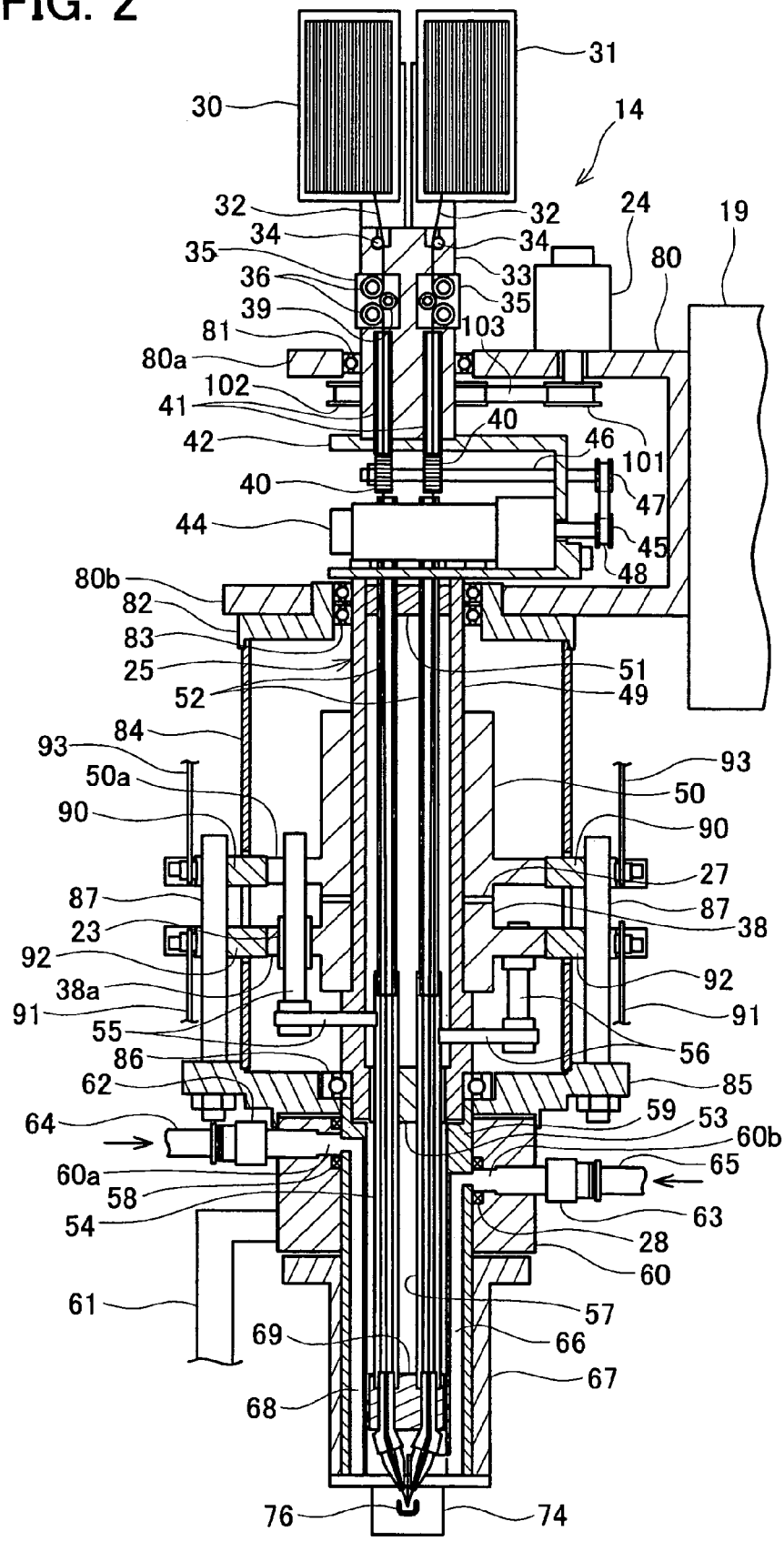
FIG. 2 shows a longitudinal sectional view of a thermal spraying tool part of the first embodiment.

The thermal spraying tool part 14 will now be described in detail. As shown in FIG. 2, a reel supporting member 33 is formed at an upper part of the tool main body 25 of the thermal spraying tool part 14. The reel supporting member 33 supports a first reel 30 and a second reel 31. Wires 32 are housed in a wound state in the reels 30 and 31. Two deflecting rollers 34 are attached to the reel supporting member 33. A correcting device 35 is provided below each of the deflecting rollers 34. The correcting devices 35 are each provided with two first correcting rollers 36, and a second correcting roller 39 that is smaller than the first correcting rollers 36. An upper pipe 41 is provided below each of the correcting devices 35. When a delivery roller 40 (to be described) rotates, the wires 32 are unreeled from the reels 30 and 31. The wires 32 that have been unreeled are deflected directly downwards by the deflecting rollers 34. The wires 32 that have been deflected directly downwards pass though, while being gripped between, the first correcting rollers 36 and the second correcting roller 39 of the correcting devices 35. Bends had been formed in the wires 32 that were wound around the reels 30 and 31, and passing these wires 32 between the first correcting rollers 36 and the second correcting roller 39 of the correcting devices 35 straightens these bends. The wires 32 that have exited the correcting devices 35 pass through the upper pipes 41.

A bracket 42 that is shaped in cross-section approximately like a sideways U is fixed to a lower end of the reel supporting member 33. A delivery motor 44 is attached within the bracket 42. The controller 15 controls speed of rotation of the delivery motor 44. A first pulley 45 is fixed to a rotary shaft of the delivery motor 44. A shaft 46 is disposed above the delivery motor 44. The shaft 46 is attached, in a manner allowing rotation, to the bracket 42. A second pulley 47 is fixed to one end of the shaft 46. A belt 48 is wound across the first pulley 45 and the second pulley 47. Two delivery rollers 40 are fixed to the other end of the shaft 46. A plurality of grooves is formed in an outer peripheral part of each delivery roller 40, and these grooves extend in an axial direction of the shaft 46 and are repeated in a circumference direction of the delivery roller 40. The wires 32 that have exited from the upper pipes 41 make contact with the outer peripheral parts of the delivery rollers 40. When the delivery motor 44 is driven, the first pulley 45 rotates. When the first pulley 45 rotates, the second pulley 47 rotates via the belt 48. The shaft 46 rotates as the second pulley 47 rotates. The delivery roller 40 rotates together with the shaft 46, whereupon the wire 32 that is making contact with the delivery roller 40 is delivered downwards. The plurality of grooves formed in the outer peripheral part of each delivery roller 40 prevents slipping between the delivery rollers 40 and the wires 32.

A first cylindrical member 49 is attached below the bracket 42. The first cylindrical member 49 is formed from insulating material. An upper exciting body 50 and a lower exciting body 38 are fixed to an outer peripheral part of the first cylindrical member 49. The upper exciting body 50 has a collar-shaped protruding slip ring 50*a*. The lower exciting body 38 has a collar-shaped protruding slip ring 38*a*. A ring-shaped insulating member 27 is attached between the upper exciting body 50 and the lower exciting body 38. An electrically insulating upper insulating member 51 is attached to an inner part of an upper end of the first cylindrical member 49. Two central pipes 52 are inserted through the upper insulating member 51. The wires 32 pass through the central pipes 52. Further, a central insulating member 53 is attached to an inner part of a lower end of the first cylindrical member 49. A first lower pipe 54 and a second lower pipe 57 are inserted through the central insulating member 53. A lower end of one of the central pipes 52, and an upper end of the first lower pipe 54, join within the first cylindrical member 49. A lower end of the other of the central pipes 52, and an upper end of the second lower pipe 57, also join within the first cylindrical member 49. One of the wires 32 passes through the first lower pipe 54. The other of the wires 32 passes through the second lower pipe 57. The first lower pipe 54 and the slip ring 50*a* of the upper exciting body 50 are electrically connected via a first exciting member 55. Moreover, the first exciting member 55 and the slip ring 38*a* of the lower exciting body 38 are mutually insulated via an insulating member 23 attached between the two. The second lower pipe 57 and the slip ring 38*a* of the lower exciting body 38 are electrically connected via a second exciting member 56.

A second cylindrical member 59 is attached at a lower end of the first cylindrical member 49. The second cylindrical member 59 passes through an air supply member 60. The air supply member 60 is fixed to the base 11 (see FIG. 1) via a support 61. A first hose 64 is connected with the air supply member 60 by means of a cap ring 62. The first hose 64 joins with a first horizontal flow path 60*a* that is formed in the air supply member 60 and extends in a horizontal direction. The first horizontal flow path 60*a* joins with an atomizing air flow path 68 that is formed in the second cylindrical member 59 and extends in a perpendicular direction. A ring-shaped elastic seal 58 is attached at a downstream end of the first horizontal flow path 60*a*. The seal 58 is pressure-welded to an outer peripheral face of the second cylindrical member 59. Air supplied from the first hose 64 is thus prevented from leaking to the exterior. Further, a second hose 65 is connected with the air supply member 60 by means of a cap ring 63. The second hose 65 joins with a second horizontal flow path 60*b* that is formed in the air supply member 60 and extends in a horizontal direction. The second horizontal flow path 60*b* joins with a first auxiliary air flow path 66 that is formed in the second cylindrical member 59 and extends in a perpendicular direction. A seal 28 is attached at a downstream end of the second horizontal flow path 60*b*. The seal 28 is pressure-welded to the outer peripheral face of the second cylindrical member 59. Air supplied from the second hose 65 is thus prevented from leaking to the exterior. A case member 67 is attached to a lower outer periphery of the second cylindrical member 59.

Figure 3:
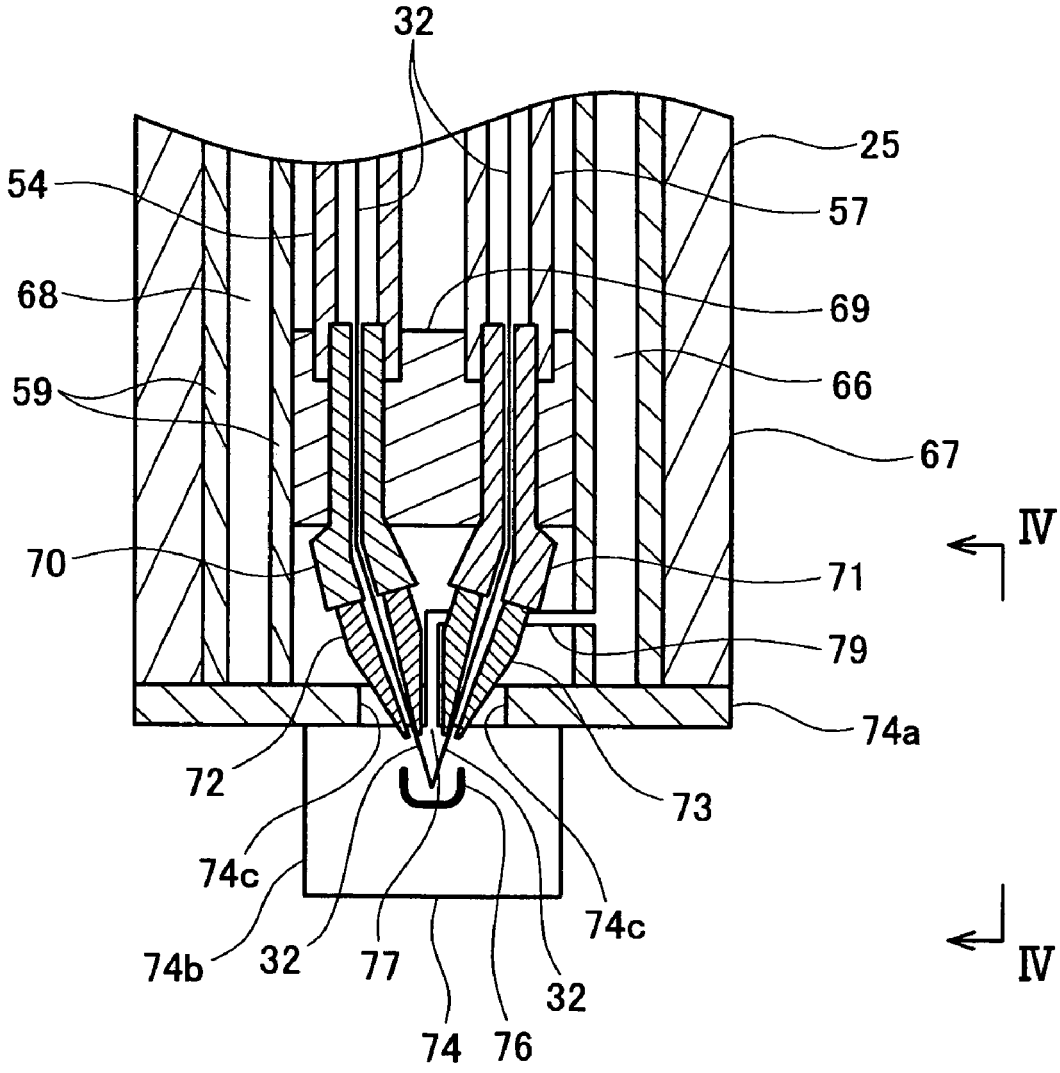
FIG. 3 shows a detailed view of a tip part of a tool main body of the first embodiment.
Figure 4:
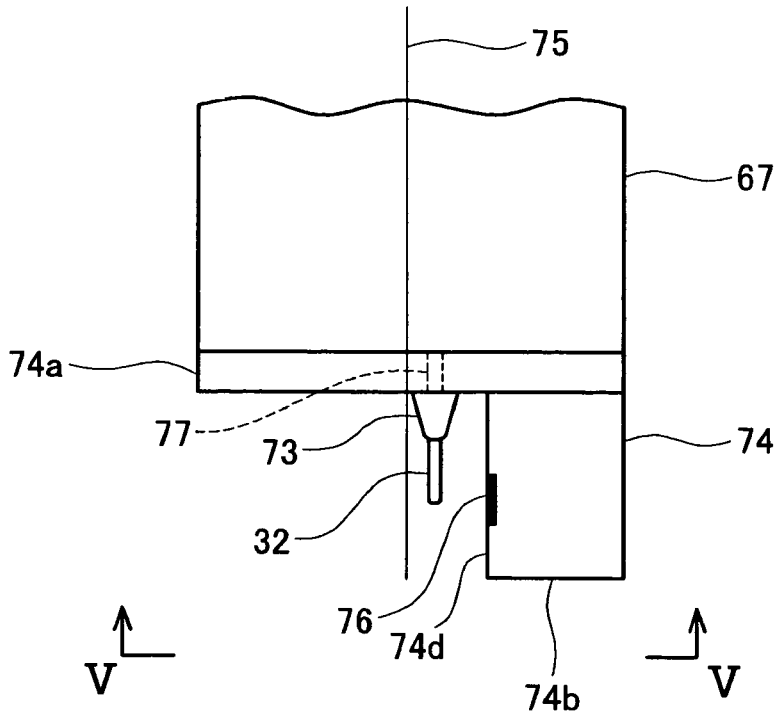
FIG. 4 shows a view along the line IV-IV of FIG. 3.
Figure 5:
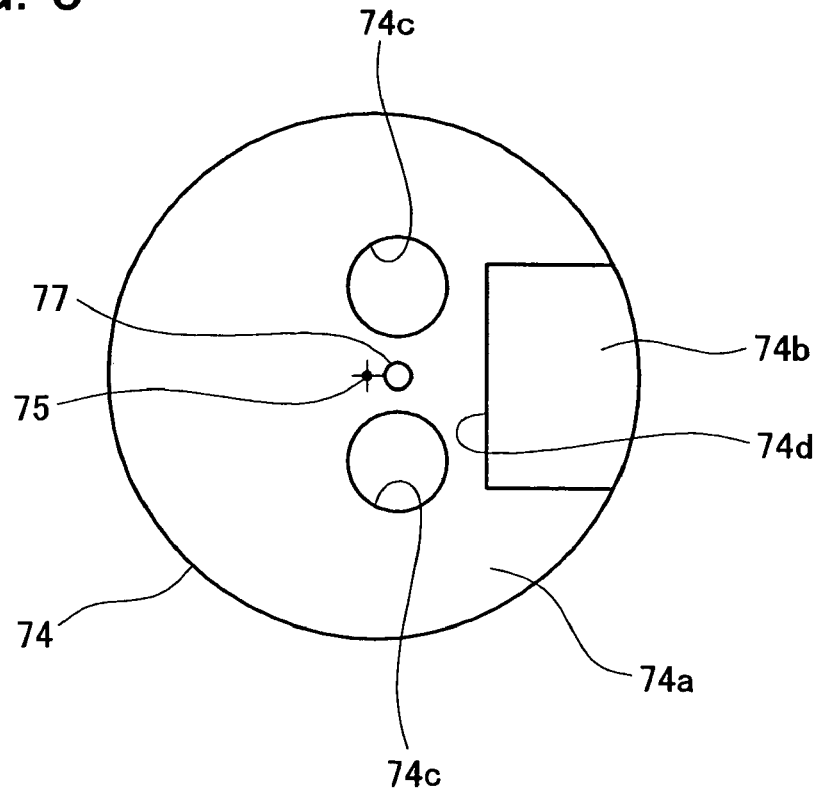
FIG. 5 shows a view along the line V-V of FIG. 4.

FIGS. 3 to 5 show a tip portion of the tool main body 25. Exciting tips 72 and 73 (to be described), and the wires 32 are not shown in FIG. 5. A lower insulating member 69 is attached to a lower part of the second cylindrical member 59. A first connecting member 70 and a second connecting member 71 pass through the lower insulating member 69. These first and second connecting members 70 and 71 extend in an up-down direction, and form through holes. An upper end of the first connecting member 70 is connected with the first lower pipe 54. An upper end of the second connecting member 71 is connected with the second lower pipe 57. The first connecting member 70 and the second connecting member 71 are bent in a direction such that their lower parts are adjacent. The first exciting tip 72 is attached to a lower end of the first connecting member 70. The second exciting tip 73 is attached to a lower end of the second connecting member 71. A through hole extending in an axial direction is formed in both the first exciting tip 72 and in the second exciting tip 73.

A tip member 74 is attached to lower ends of the second cylindrical member 59 and the case member 67. A disc-shaped cap part 74*a*, and a nozzle part 74*b* protruding downwards from the cap part 74*a*, are formed on the tip member 74. The first exciting tip 72 and the second exciting tip 73 pass through two through holes 74*c* formed in the cap part 74*a* of the tip member 74. As shown in FIG. 3, the wires 32 penetrate the through holes of the first connecting member 70 and the first exciting tip 72, and penetrate the through holes of the second connecting member 71 and the second exciting tip 73. A tip of each of the two wires 32 is led through the first exciting tip 72 and the second exciting tip 73 respectively and are brought together, thus creating a short circuit. The tips of the wires 32 are located closer than the nozzle part 74*b* to a rotary shaft 75 of the tool main body 25. This is shown clearly in FIG. 4.

As shown in FIG. 3, a U-shaped atomizing nozzle 76 opens in the nozzle part 74*b* of the tip member 74. The atomizing nozzle 76 and the atomizing air flow path 68 in the second cylindrical member 59 are joined by a flow path (not shown). Consequently, air supplied from the exterior to the first hose 64 is propelled in a horizontal direction from the atomizing nozzle 76.

As shown in FIG. 5, an auxiliary nozzle 77 opens in the cap part 74*a* of the tip member 74. The auxiliary nozzle 77 opens directly above the contacting tips of the wires 32. As shown in FIG. 3, the auxiliary nozzle 77 is joined, via a second auxiliary air flow path 79, with the first auxiliary air flow path 66 of the second cylindrical member 59. Consequently, when air is supplied to the second hose 65 from the exterior, this air is blown downwards from the auxiliary nozzle 77. The air that is being blown downwards from the auxiliary nozzle 77 is blown onto the contacting tips of the wires 32.

The configuration of the tool main body 25 was described above. Next, a configuration that supports the tool main body 25 will be described.

As shown in FIG. 2, a support 80 that is shaped in cross-section approximately like a sideways U is attached to the slider 19. An upper part of the support 80 has an upper horizontal part 80*a* extending in a horizontal direction, and a lower part of the support 80 has a lower horizontal part 80*b* extending in a horizontal direction. A bearing 81 is attached between the horizontal part 80*a* and the reel supporting member 33 of the tool main body 25. An approximately disc-shaped upper cover 82 is attached to the lower horizontal part 80*b*. Two bearings 83 are attached between the upper cover 82 and an upper end part of the first cylindrical member 49 of the tool main body 25. An approximately disc-shaped lower cover 85 is attached via a bearing 86 to a lower end part of the first cylindrical member 49. The upper cover 82 and the lower cover 85 are joined by means of a cylindrical central cover 84. This configuration allows the tool main body 25 to rotate around an axial direction while being supported by the support 80.

Two holders 87 are fixed to an outer peripheral part of the lower cover 85. These holders 87 are column shaped, extend upwards, and are formed from electrically insulating material. An upper power member 90 and a lower power member 92 are attached respectively to each of the holders 87. A power line 93 is connected with the upper power member 90, and a power line 91 is connected with the lower power member 92. DC power is carried by the power lines 91 and 93. Through holes, through which the power members 90 and 92 pass, are formed in the central cover 84. The upper power member 90 is connected to the slip ring 50*a* of the upper exciting body 50 via an exciting brush (not shown). The lower power member 92, also, is connected to the slip ring 38*a* of the lower exciting body 38 via an exciting brush. In this configuration, an electrical path is formed from the power line 93 to one of the wires 32 via the upper power member 90, the slip ring 50*a*, the first exciting member 55, the first lower pipe 54, the first connecting member 70, and the first exciting tip 72. Moreover, an electrical path is formed, from the other wire making contact at the tip with the first wire, to the power line 91 via the second exciting tip 73, the second connecting member 71, the second lower pipe 57, the second exciting member 56, the slip ring 38*a*, and the lower power member 92.

As shown in FIG. 2, the motor 24 for rotation is attached to an upper face of the upper horizontal part 80*a* of the support 80. A third pulley 101 is attached to a rotary shaft of the motor 24 for rotation. A fourth pulley 102 is attached to the reel supporting member 33 of the tool main body 25. A belt 103 is wound across the third pulley 101 and the fourth pulley 102. As a result, when the motor 24 for rotation is driven, its driving force is transmitted to the fourth pulley 102 via the third pulley 101 and the belt 103, and the tool main body 25 rotates.

As has already been described, the air supply member 60, through which the second cylindrical member 59 of the tool main body 25 passes, is fixed to the base 11 via the support 61. Consequently, when the tool main body 25 rotates, the second cylindrical member 59 rotates while its outer peripheral face slides against the air supply member 60. At this juncture, the second cylindrical member 59 also slides against the seals 28 and 58 of the air supply member 60. Further, when the tool main body 25 rotates, the slip ring 50*a* of the upper exciting body 50 rotates while sliding against the upper power member 90. The slip ring 38*a* of the lower exciting body 38 also rotates while sliding against the lower power member 92.

When the thermal spraying device 10 performs thermal spraying, DC power is applied by the power lines 91 and 93. When excited, an arc appears between the contacting tips of the wires 32, and the heat from this arc melts the tips of the wires 32. The delivery roller 40 rotates so that the wires 32 are unreeled from the reels 30 and 31, and this replaces a proportion of the wires 32 equal to that which has melted and been consumed . Air is supplied to the first hose 64 and the second hose 65. When air is supplied, auxiliary air is blown from the auxiliary nozzle 77, and atomizing air is propelled from the atomizing nozzle 76.

Figure 6:
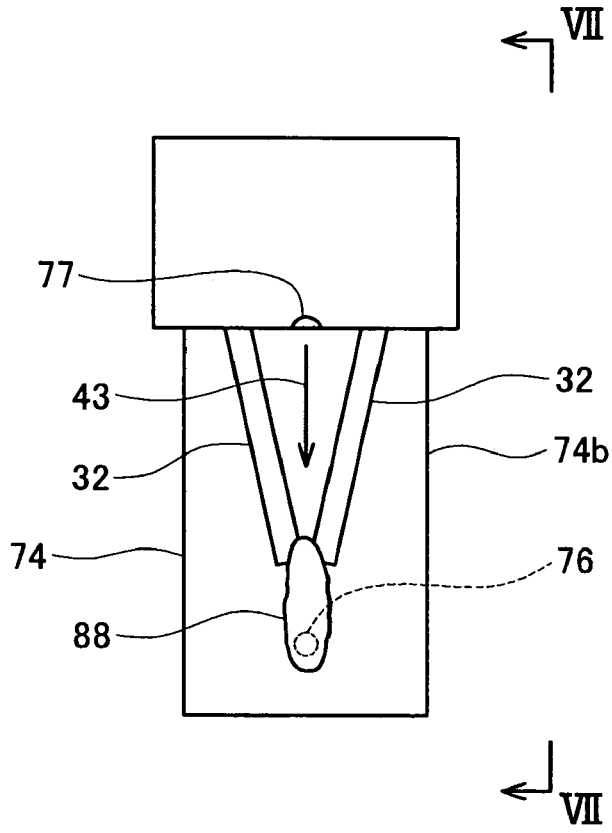
FIG. 6 schematically shows a state in which the tip part of the tool main body of the first embodiment is performing thermal spraying.
Figure 7:
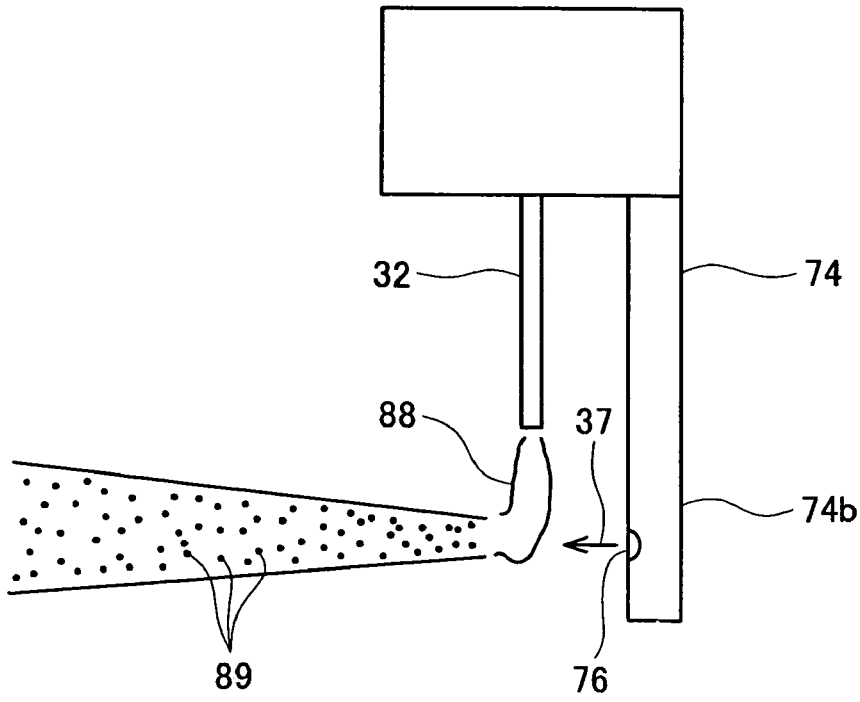
FIG. 7 schematically shows a view along the line VII-VII of FIG. 6.

FIG. 6 schematically shows a state in which tips of the wire 32 are melting, and auxiliary air 43 is being blown from the auxiliary nozzle 77. In this state, the auxiliary air 43 is blown onto a molten droplet 88 of the wires 32, and consequently the droplet 88 deforms such that it extends downwards. Then, as shown in FIG. 7, atomizing air 37 propelled from the atomizing nozzle 76 is blown onto the tip portion of elongated droplets 88, and consequently the droplets 88 is finely atomized into fine particles (atomized droplets) 89 at the tip portion of elongated droplets 88. The atomized droplets 89 are scattered towards the inner face of the bore 29 and smashed against the inner face of the bore 29.

In this state, the tool main body 25 is rotated while the thermal spraying tool part 14 is being gradually raised or lowered within the bore 29 of the cylinder block 26, and the sprayed particles (atomized droplets) 89 are thus thermally sprayed onto the entire inner face of the bore 29. The sprayed particles 89 that have thus been thermally sprayed adhere to the inner face of the bore 29 to form a thermally sprayed coating. Furthermore, the gas for atomizing the atomized droplets is not limited to air, but can also be a gas other than air.

If a tool main body is fixed in position when a bore of a cylinder block is to be thermally sprayed, the cylinder block itself must be rotated at high speed. However, since the cylinder block is heavy, rotating it at high speed means that a device for this purpose must be large, and is therefore unrealistic. Further, only one bore can be thermally sprayed at a time if the cylinder block is rotated. In the thermal spraying device 10 of the present embodiment, the tool main body 25 is rotated, and consequently the device is not large. Moreover, bores of a multi-cylinder cylinder block can be thermally sprayed simultaneously by providing a plurality of thermal spraying devices 10.

The thermal spraying device 10 of the present embodiment is also capable of performing thermal spraying on a flat face.

Figure 8:
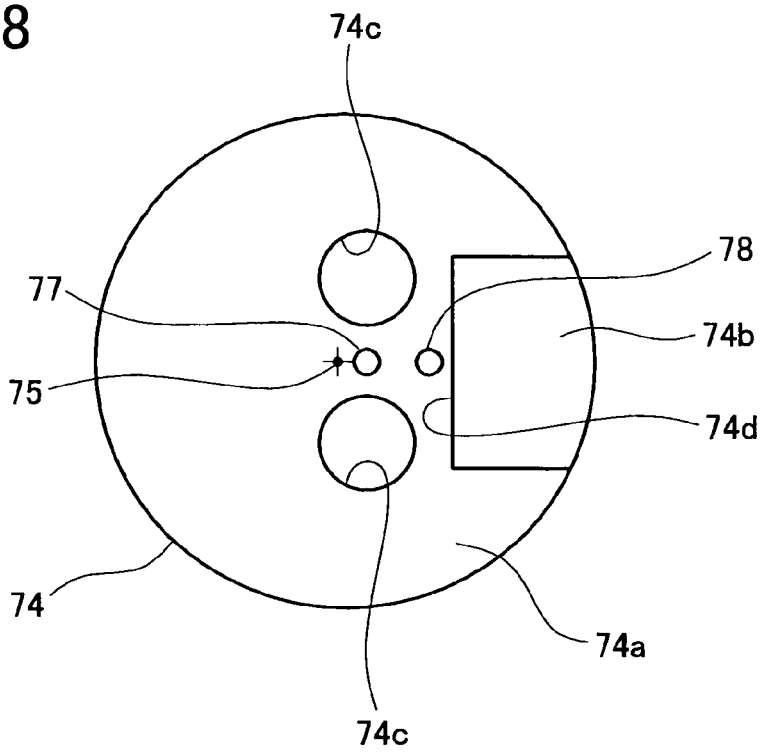
FIG. 8 shows an explanatory view of a version in which a nozzle has been added to a cap part of the first embodiment.

As shown in FIG. 8, a nozzle 78 which propels air downwards may also be provided in the cap part 74*a* between the auxiliary nozzle 77 and an anterior face 74*d* of the nozzle part 74*b*. The nozzle 78 propels air and prevents the auxiliary air 43 that is being blown from the auxiliary nozzle 77 from being deflected toward the nozzle part 74*b*. The auxiliary air 43 can thus reliably be blown to the contacting tips of the wires 32. The nozzle 78 for spraying air is provided due to the following hydromechanical effect. When fluid (the auxiliary air 43) is propelled along a wall face (the anterior face 74*d* of the nozzle part 74*b*), this fluid tends to be drawn towards the wall face. If the nozzle 78 is not provided to propel air, the auxiliary air 43 tends to be deflected towards the nozzle part 74*b*. The nozzle 78 prevents the auxiliary air 43 from being deflected toward the nozzle part 74*b*. The auxiliary air 43 can thus reliably be blown to the contacting tips of the wires 32.

Second Embodiment

A thermal spraying device of a second embodiment of the present invention will now be described. Only different features of the second embodiment from the first embodiment will be described, and a description that overlaps with that of the first embodiment will be omitted.

Figure 9:
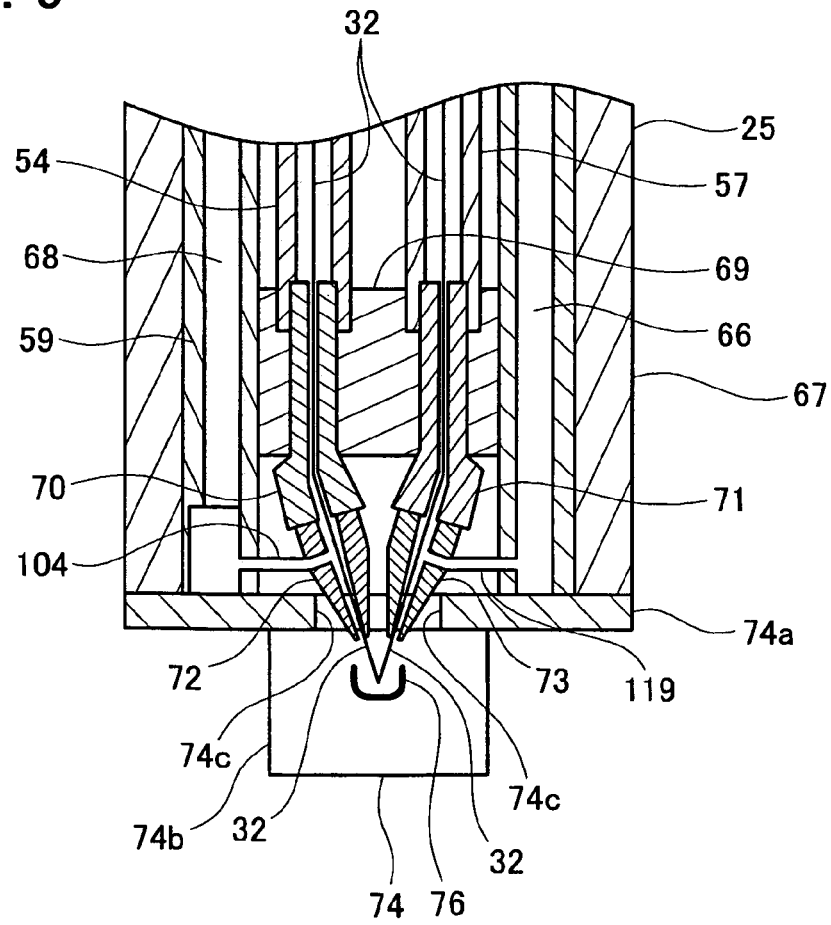
FIG. 9 shows a detailed view of a tip part of a tool main body of a second embodiment.

As shown in FIG. 9, the first auxiliary air flow path 66 joins, via a third auxiliary air flow path 119, with the through hole of the second exciting tip 73. Moreover, the first auxiliary air flow path 66 joins with a fourth auxiliary air flow path 104 via a path (not shown). The fourth auxiliary air flow path 104 joins with the through hole of the first exciting tip 72. Consequently, auxiliary air is blown from the tips of the first exciting tip 72 and the second exciting tip 73 when air is supplied to the second hose 65.

Figure 10:
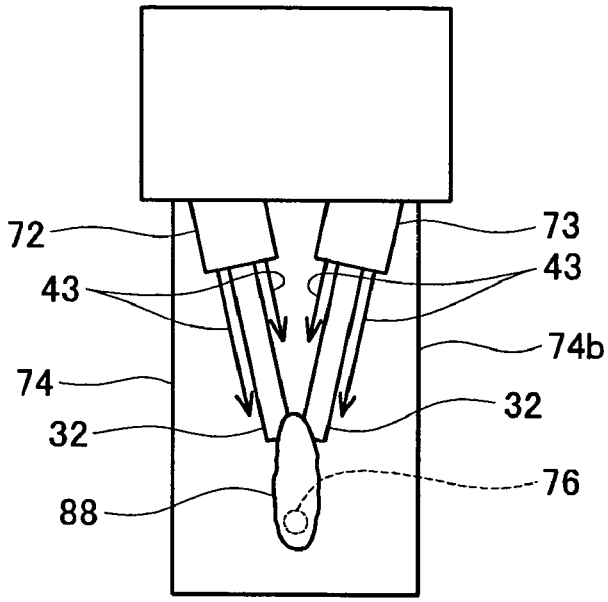
FIG. 10 schematically shows a state in which the tip part of the tool main body of the second embodiment is performing thermal spraying.

FIG. 10 schematically shows a state in which tips of the wires 32 are melting, and the auxiliary air 43 is being blown from the tips of the first exciting tip 72 and the second exciting tip 73. Consequently, the molten droplet 88 of the wires 32 is deformed by the auxiliary air 43 such that the droplet 88 extends downwards. Atomizing air is propelled from the atomizing nozzle 76 towards the tip portion of the elongated molten droplet 88, and consequently the droplet 88 is atomized into fine spray particles.

Third Embodiment

Only parts characteristic of the third embodiment will be described.

Figure 11:
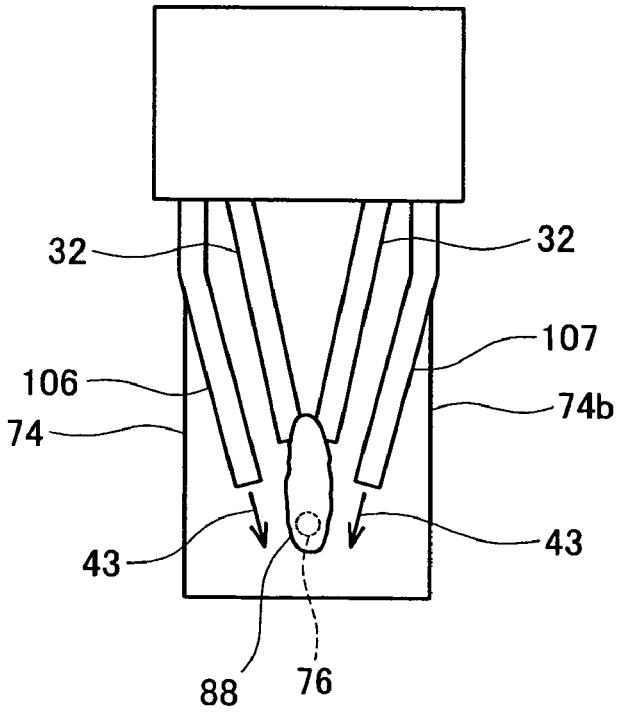
FIG. 11 schematically shows a state in which a tip part of a tool main body of a third embodiment is performing thermal spraying.

FIG. 11 schematically shows a tip part of a tool main body of the present embodiment. In the present embodiment, a first auxiliary air pipe 106 and a second auxiliary air pipe 107 are provided. The first auxiliary air pipe 106 and the second auxiliary air pipe 107 bend inwards, and blow auxiliary air 43 towards an area below the contacting tips of the wires 32. The auxiliary air 43 that is blown creates negative pressure at a location below the contacting tips of the wires 32. This negative pressure causes the molten droplet 88 of the wires 32 to deform such that it extends downwards. Atomizing air 37 is propelled from the atomizing nozzle 76 towards the tip portion of the elongated molten droplet 88, and consequently the droplets 88 is atomized into fine spray particles.

In the present embodiment, the auxiliary air 43 is not blown directly onto the molten droplets 88, and the shaping of the molten droplets 88 is consequently more stable. As a result, the shape of the spray particles atomized and scattered by the atomizing air 37 is more uniform.

Fourth Embodiment

Only parts characteristic of the fourth embodiment will be described.

Figure 12:
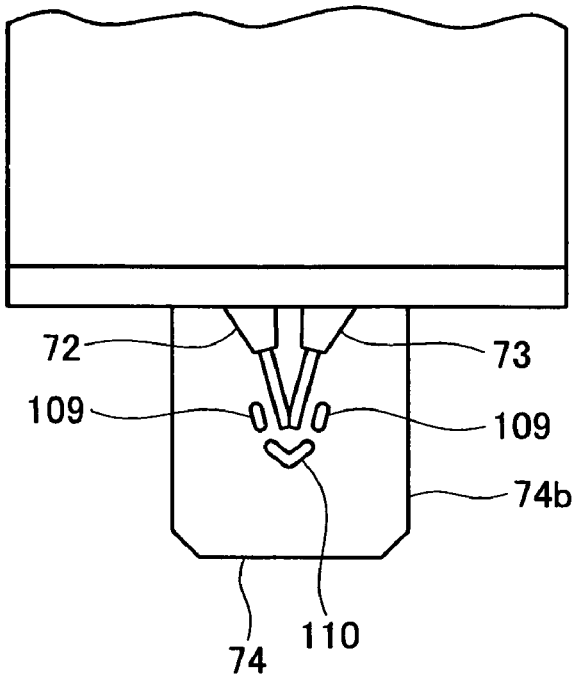
FIG. 12 shows a tip part of a tool main body of a fourth embodiment.

FIG. 12 schematically shows a tip part of a tool main body. Two upper nozzles 109 and a V-shaped lower nozzle 110 open into the nozzle part 74*b*. Atomizing air supplied from the first hose 64 is propelled from the upper nozzles 109 and the lower nozzle 110. A restrictor (a diaphragm) is provided in an upper side of a flow path of the upper nozzles 109. Consequently, the atomizing air propelled from the upper nozzles 109 is less powerful (has a slower current speed) than the atomizing air propelled from the lower nozzle 110.

Figure 13:
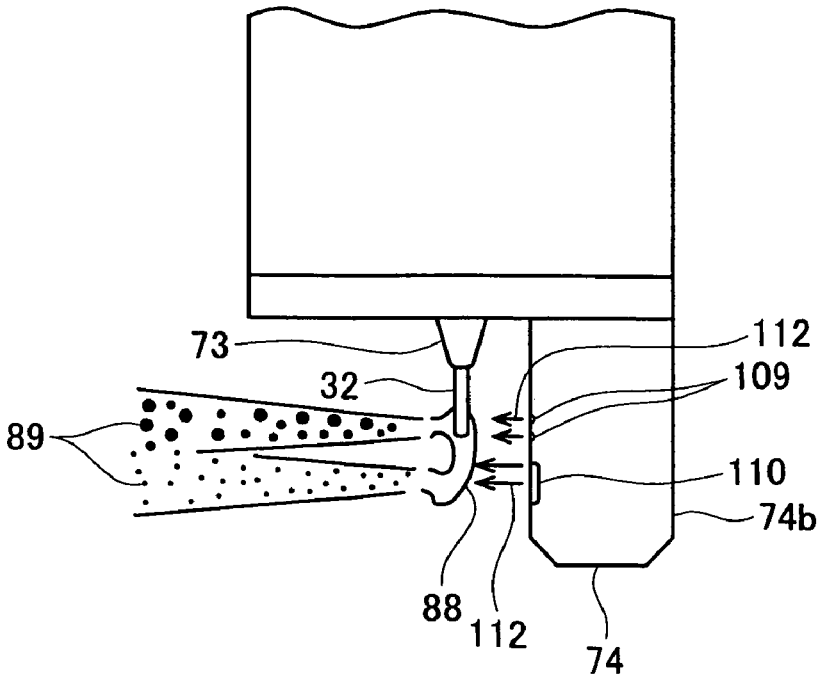
FIG. 13 schematically shows a state in which the tip part of the tool main body of the fourth embodiment is performing thermal spraying.

As shown in FIG. 13, atomizing air 112 is propelled from the upper nozzles 109 and the lower nozzle 110 onto the molten droplet 88 formed from the contacting tips of the wires 32. In this case, the atomizing air 112 propelled from the upper nozzles 109 is weak, and consequently the atomized droplets forms larger spray particles 89. The atomizing air 112 propelled from the lower nozzle 110 is strong, and consequently the droplets 88 is atomized into smaller spray particles 89. As a result, when the tool main body 25 is rotated while the thermal spraying tool part 14 is being raised, the larger spray particles 89 atomized by the atomizing air 112 propelled from the upper nozzles 109 are thermally sprayed first onto the inner face of the bore 29. The thermal spraying tool part 14 is being raised, and consequently the smaller spray particles 89 atomized by the atomizing air 112 propelled from the lower nozzle 110 are subsequently thermally sprayed onto the sprayed coating consisting of the larger spray particles 89.

Since the larger spray particles 89 have a larger mass, they have a larger kinetic energy and larger thermal energy. The spray particles 89 with larger kinetic energy collide strongly with the inner face of the bore 29, and the sprayed particles 89 with larger thermal energy collide in a more melted state with the inner face of the bore 29. As a result, the larger spray particles 89 adhere strongly to the inner face of the bore 29. Since a surface of the sprayed coating formed from the larger spray particles 89 is extremely uneven, the smaller spray particles 89 thermally sprayed thereto adhere strongly. The smaller spray particles 89 form a finely textured sprayed coating. When a honing process is performed on this finely textured sprayed coating, moderately uneven oil pits are formed. In the thermal spraying device of the present embodiment, it is thus possible to form a sprayed coating that has strong adherence to the inner face of the bore 29 and is finely textured by raising the tool main body in a single pass.

A configuration is also possible in which strong atomizing air 112 is propelled from the upper nozzles 109 and weak atomizing air 112 is propelled from the lower nozzle 110. In this case, thermal spraying is performed while the tool main body is being lowered. In this case, also, a thermally sprayed coating formed from smaller spray particles 89 is thermally sprayed onto a thermally sprayed coating formed from larger spray particles 89.

A nozzle that propels weak atomizing air, and a nozzle that propels strong atomizing air, may also be provided in a horizontal direction. In this case, the tool main body is rotated from the side of the nozzle that propels strong atomizing air to the side of the nozzle that propels weak atomizing air. Thereupon, a coating formed from smaller spray particles is thermally sprayed onto a thermally sprayed coating formed from larger spray particles.

In addition to the atomizing air 112 described above, auxiliary air 43 as set forth in the first to third embodiments can also be blown. Blowing the auxiliary air 43 causes the molten droplet 88 to extend downwards, and the atomizing performed by the atomizing air 112 can be more effective.

In the thermal spraying devices of the first embodiment, the second embodiment, and the third embodiment, there is a fixed positional relationship between the wires and the direction in which the atomizing air is blown, and the atomizing air is always propelled to the droplet from a direction orthogonal to the V-shape of wires 32. As described above, when the atomizing air is propelled to the droplet from a direction orthogonal to the V-shape, the droplet turns into fine spray particles that are uniform in size. A sprayed coating can thus be formed on the entire circumference of the inner face of the bore by performing thermal spraying while rotating the tool main body 25. A high quality sprayed coating can thus be formed.

FIG. 21 summarizes the results of tests in which the amount of flow of atomizing air and auxiliary air was varied while using the thermal spraying devices of the first embodiment, the second embodiment, and the third embodiment (below, the thermal spraying device of the first embodiment will be termed 'type 1', the thermal spraying device of the second embodiment will be termed 'type 2', and the thermal spraying device of the third embodiment will be termed 'type 3'. 'W' in the uppermost row of FIG. 21 shows the total flow of atomizing air and auxiliary air (liters/min). 'Ratio' in the row below shows the ratio (%) of auxiliary air with respect to the total flow 'W'. '○, Δ, x' show the arcing condition between the tips of the wires 32 for type 1, type 2, and type 3 respectively. Specifically, '○' means that a stable arcing occurred. 'Δ' means that there was no stoppage of arcing, but that occasionally a crackling noise occurred. 'x' means that a stable arcing did not occur. As is clear from FIG. 21, the greater the ratio of auxiliary air, the more difficult it is for the stable arcing to occur. This reason for this is that the greater the ratio of auxiliary air, the more powerfully the auxiliary air is blown onto the tips of the wires 32, and the tips of the wires 32 consequently mutually separate. In the case where the ratio of auxiliary air is 5 to 20 (%), a stable arcing occurred for type 1, type 2, and type 3.

In the case where '○' has been written for type 1, a relatively high quality sprayed coating was formed, but larger spray particles were occasionally mixed therein. Where '○' has been written for type 2 and type 3, a high quality sprayed coating was formed.

Figure 22:
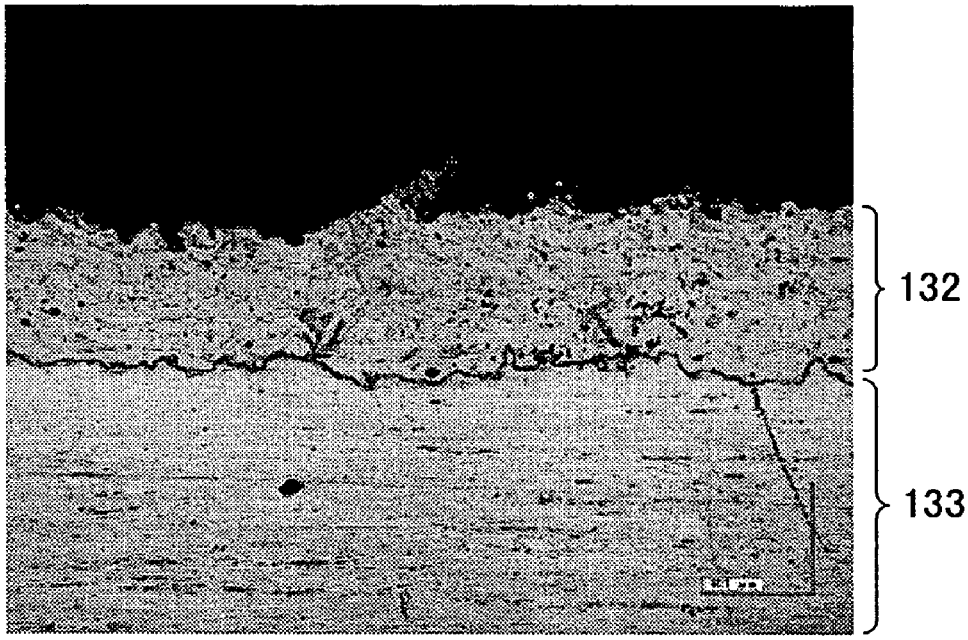
FIG. 22 shows a photograph of a cut plane of a thermally sprayed coating sprayed by using an embodiment of the thermal spraying device.
Figure 23:
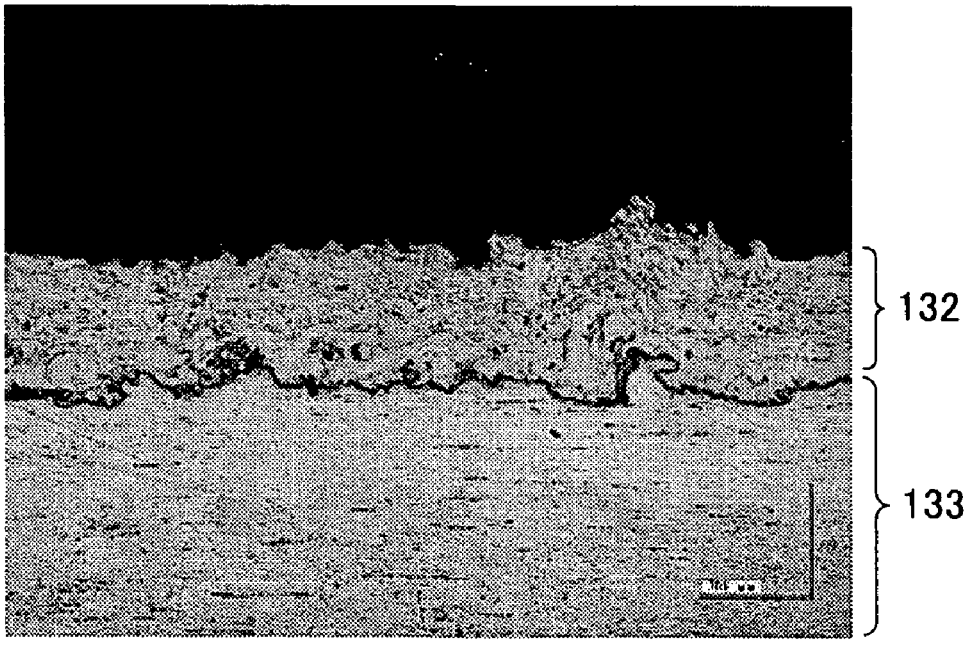
FIG. 23 shows another photograph of a cut plane of a thermally sprayed coating sprayed by using an embodiment of the thermal spraying device.

FIG. 22 shows a sprayed coating 132 formed by using the type 1 thermal spraying device. As is clear from FIG. 22, the sprayed coating 132 has sprayed particles of uniform size and is high quality. FIG. 23 shows the sprayed coating 132 at a position moved 90 degrees, along the axial direction of the bore, from the location of the sprayed coating 132 in FIG. 22. This sprayed coating 132 is also high quality. The adhesive strength of the sprayed coating of FIGS. 22 and 23 was tested by the shear method, and had sufficient adhesive strength, achieving a result of 100 (MPa). Further, the thermal spraying conditions for forming the adhesive strength of the sprayed coating of FIGS. 22 and 23 were as follows: the thermal spraying materials (the wire) was 'Fe-0.8% C', the diameter of the wire was 1.6 (mm), the delivery speed of the wire was 80 (mm/sec), current was 210 (A), the pressure of the supplied air was 6.0 (kg/cm$^2$), and the temperature of the supplied air was room temperature.

The embodiments described above merely illustrate some possibilities of the invention and do not restrict the claims thereof. The art set forth in the claims encompasses various transformations and modifications to the embodiments described above.

Furthermore, the technical elements disclosed in the present specification or figures may be utilized separately or in all types of conjunctions and are not limited to the conjunctions set forth in the claims at the time of filing the application. Furthermore, the art disclosed in the present specification or figures may be used to simultaneously realize a plurality of aims or to realize one of these aims.

What is claimed is:

1. A thermal spraying method comprising:

a step of delivering a plurality of wire-shaped thermal spraying materials to maintain a positional relationship where tips of the thermal spraying materials are located mutually adjacent while the tips of the thermal spraying materials are consumed, a step of applying a voltage difference between the plurality of thermal spraying materials to generate an arc between the tips of the thermal spraying materials, a first step of blowing a droplet formed near the tips of the thermal spraying materials by the arc to lengthen the droplet into a lengthened droplet, and a second step of further blowing the lengthened droplet to atomize it into atomized droplets and to scatter the atomized droplets towards a face to be thermally sprayed, wherein the second step comprises an initial sub-step of atomizing a portion of the lengthened droplet into the atomized droplets by a low speed blow at a first position and a subsequent sub-step of atomizing a portion of the lengthened droplet not atomized in the initial sub-step into atomized droplets by a high speed blow at a second position, wherein the second position is located at a downstream side of the first position along the blowing direction of the first step.

2. A thermal spraying method of claim 1, wherein the face is initially coated with atomized droplets atomized by the low speed blow and subsequently coated with atomized droplets atomized by the high speed blow.

3. A thermal spraying device comprising:

a delivery mechanism for delivering a plurality of wire-shaped thermal spraying materials to maintain a positional relationship where tips of the thermal spraying materials are located mutually adjacent while the tips of the thermal spraying materials are consumed, an exciting mechanism for applying a voltage difference between the plurality of thermal spraying materials to generate an arc between the tips of the thermal spraying materials, a first blowing mechanism for lengthening a droplet into a lengthened droplet formed near the tips of the thermal spraying materials by the arc, and a second blowing mechanism for blowing the lengthened droplet into atomized droplets and smashing the atomized droplets onto a face to be thermally sprayed, wherein the second blowing mechanism comprises a low speed blower disposed proximate the tips of the thermal spraying materials for blowing a first portion of the lengthwise droplet into first atomized droplets, and a high speed blower disposed spaced away from the tips of the thermal spraying materials for blowing a second portion of the lengthened droplet not atomized by the lower speed blower into second atomized droplets, the high speed blower being located at a downstream side of the low speed blower along a blowing direction of the first blowing mechanism.

4. A thermal spraying device of claim 3, wherein the second blowing mechanism is disposed in a symmetrical plane of two wire-shaped thermal spraying materials.

5. A thermal spraying device of claim 3, further comprising:

a rotating mechanism for rotating the entirety of the delivery mechanism, the exciting mechanism, the first blowing mechanism, and the second blowing mechanism.

6. A thermal spraying device of claim 5, wherein the tips of the thermal spraying materials are located in a position offset from a rotary center of the rotating mechanism so as to optimize a distance from the tips of the thermal spraying materials to the face to be thermally sprayed.

7. A thermal spraying device of claim 3, further comprising:

a moving mechanism for moving the entirety of the delivery mechanism, the exciting mechanism, the first blowing mechanism, and the second blowing mechanism only along a non-reciprocal line extending from the high speed blower to the low speed blower.

* * * * *